US006994456B1

(12) United States Patent
Russo et al.

(10) Patent No.: US 6,994,456 B1
(45) Date of Patent: Feb. 7, 2006

(54) WALL-WASH LIGHTING

(75) Inventors: Neil Russo, Howell, NJ (US); Steven M. Silverstein, Woodcliff Lake, NJ (US)

(73) Assignee: Kurt Versen Company, Westwood, NJ (US)

( * ) Notice: Subject to any disclaimer, the term of this patent is extended or adjusted under 35 U.S.C. 154(b) by 58 days.

(21) Appl. No.: 10/833,849

(22) Filed: Apr. 28, 2004

(51) Int. Cl.
*F21V 5/02* (2006.01)

(52) U.S. Cl. ..... 362/364; 362/147; 362/339

(58) Field of Classification Search ..... 362/147, 362/327, 328, 330, 331, 332, 333, 339, 364, 362/365, 366
See application file for complete search history.

(56) References Cited

U.S. PATENT DOCUMENTS

| | | | | |
|---|---|---|---|---|
| 330,356 | A | 11/1885 | Trotter | |
| 1,350,295 | A | 8/1920 | Champeau | |
| 1,900,436 | A | 3/1933 | Dourgnon | |
| 2,044,224 | A | 6/1936 | Peple, Jr. | |
| 2,101,199 | A | 12/1937 | Rolph | |
| 3,600,569 | A | 8/1971 | Matteson | |
| 4,450,509 | A | 5/1984 | Henry | |
| 4,564,888 | A | 1/1986 | Lewin et al. | |
| 4,652,979 | A | 3/1987 | Arima | |
| 4,722,023 | A | 1/1988 | Arima et al. | |
| 5,086,375 | A * | 2/1992 | Fabbri et al. | 362/147 |
| 5,146,393 | A | 9/1992 | Crane | |
| 5,228,773 | A * | 7/1993 | Win | 362/339 |
| 5,278,737 | A | 1/1994 | Luce et al. | |
| 5,530,628 | A | 6/1996 | Ngai | |
| 6,335,999 | B1 | 1/2002 | Winston et al. | |
| 6,354,725 | B1 | 3/2002 | Simon | |
| 6,379,016 | B1 | 4/2002 | Boyd et al. | |
| 6,525,750 | B1 | 2/2003 | Knox | |
| 6,550,940 | B2 | 4/2003 | Kamiya et al. | |
| 6,561,670 | B1 | 5/2003 | Jongewaard et al. | |
| 6,632,006 | B1 * | 10/2003 | Rippel et al. | 362/364 |

* cited by examiner

*Primary Examiner*—Y. My Quach-Lee
(74) *Attorney, Agent, or Firm*—Arthur Jacob

(57) ABSTRACT

A wall-washer lighting fixture is installed flush with a ceiling surface and directs light horizontally and vertically along adjacent wall surfaces, closely adjacent to the intersection between the ceiling and the wall surfaces in order to reduce to a minimum any shaded area along wall surfaces adjacent the intersection. The lighting fixture includes first lens elements oriented, located and configured for directing light toward first areas of the wall surface, spaced vertically downwardly from the intersection, and a second lens element located vertically lower than the first lens elements and oriented and configured for directing light toward second areas of the wall surface, located between the first areas and the intersection between the ceiling surface and the wall surface, so as to illuminate the wall surface more uniformly while reducing to a minimum any shaded area along the wall surface adjacent the intersection. A method places the first and second lens elements so as to accomplish the aforesaid illumination of the wall surface.

19 Claims, 14 Drawing Sheets

WALL-WASH LIGHTING

BACKGROUND OF THE INVENTION

The present invention relates generally to lighting fixtures and lighting methods and pertains, more specifically, to wall-wash lighting methods and wall-washer lighting fixtures for installation in a ceiling to light an adjacent wall along a wall area extending essentially to the intersection between the wall and the ceiling.

Wall-washer lighting fixtures usually are ceiling-mounted fixtures used to direct light to an adjacent wall for spreading light along the wall surface. The most desirable ceiling fixtures currently in demand are those which are recessed within the ceiling so as not protrude below the level of the ceiling surface. However, such desired flush mounting of lighting fixtures presents a problem for wall-washer lighting fixtures in that currently-available recessed wall-washer fixtures are not capable of lighting a wall all the way up to the intersection between the wall and the ceiling. Even the best of these current wall-washers will leave a very discernable, sharply defined shaded area between the lighted portion of the wall and the ceiling.

The present invention provides a unique, flush-mounted ceiling wall-washer lighting fixture and a method capable of directing light to an adjacent wall so as to illuminate the wall essentially all the way up to the intersection with the ceiling. There is no discernable, sharp shaded area since sufficient light is directed close enough to the intersection of the wall and the ceiling to avoid the undesired shading.

OBJECTS OF THE INVENTION

As such, the present invention attains several objects and advantages, some of which are summarized as follows: Allows the desired flush mounting of a ceiling wall-washer lighting fixture which accomplishes the illumination of an adjacent wall essentially all the way up to the intersection between the wall and the ceiling; provides an effective, unobtrusive ceiling-mounted wall-washer for casting light along an adjacent wall, without an undesirable shaded area near the intersection between the wall and the ceiling; incorporates a light-directing arrangement in a recessed ceiling-mounted wall-washer lighting fixture and method for enabling the illumination of a wall essentially all the way up to the intersection of the wall with the ceiling; extends the useful range of installations of wall-washer lighting fixtures by virtue of enabling essentially complete and more uniform illumination of a wall by a flush-mounted wall-washer; attains aesthetically appealing lighting effects with less complex lighting fixture installations; provides effective and desirable illumination with increased ease and economy of installation for widespread adoption and use.

BRIEF SUMMARY OF THE INVENTION

The above objects and advantages, as well as further objects and advantages, are attained by the present invention which may be described briefly as a wall-washer lighting fixture for placement in a ceiling at an installation site located relative to a generally horizontal ceiling surface placed at a predetermined vertical level, the installation site further being located adjacent an intersection between the ceiling surface and a generally vertical wall surface, with the lighting fixture essentially flush with the ceiling surface and directing light horizontally and vertically along the wall surface closely adjacent to the intersection in order to illuminate the wall surface while reducing to a minimum any shaded area along the wall surface adjacent the intersection, the lighting fixture comprising: a light source for location vertically above the ceiling surface when the lighting fixture is at the installation site; a plurality of lens elements for placement between the light source and the predetermined vertical level of the ceiling surface when the lighting fixture is at the installation site, to receive light from the light source and direct such received light toward the wall surface, the plurality of lens elements including first lens elements oriented, located and configured for directing light received from the light source toward first areas of the wall surface spaced vertically downwardly from the intersection, and a second lens element located vertically lower than the first lens elements and oriented and configured for directing light received from the light source toward second areas of the wall surface, between the first areas and the intersection between the ceiling surface and the wall surface, so as to illuminate the wall surface while reducing to a minimum any shaded area along the wall surface adjacent the intersection.

In addition, the present invention includes a method for lighting a generally vertical wall surface with a lighting fixture placed in a ceiling at an installation site located relative to a generally horizontal ceiling surface located at a predetermined vertical level, the installation site further being located adjacent an intersection between the ceiling surface and the generally vertical wall surface, with the lighting fixture essentially flush with the ceiling surface and directing light from a light source horizontally and vertically along the wall surface closely adjacent to the intersection in order to illuminate the wall surface while reducing to a minimum any shaded area along the wall surface adjacent the intersection, the method comprising: placing a plurality of lens elements between the light source and the predetermined vertical level of the ceiling surface to receive light from the light source and direct such received light toward the wall surface, the placement of the plurality of lens elements including placing first lens elements so as to direct light received from the light source toward first areas of the wall surface spaced vertically downwardly from the intersection; and placing a second lens element vertically lower than the first lens elements so as to direct light received from the light source toward second areas of the wall surface, between the first areas and the intersection between the ceiling surface and the wall surface, so as to illuminate the wall surface while reducing to a minimum any shaded area along the wall surface adjacent the intersection.

BRIEF DESCRIPTION OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE PREFERRED EMBODIMENTS

Figure 1:
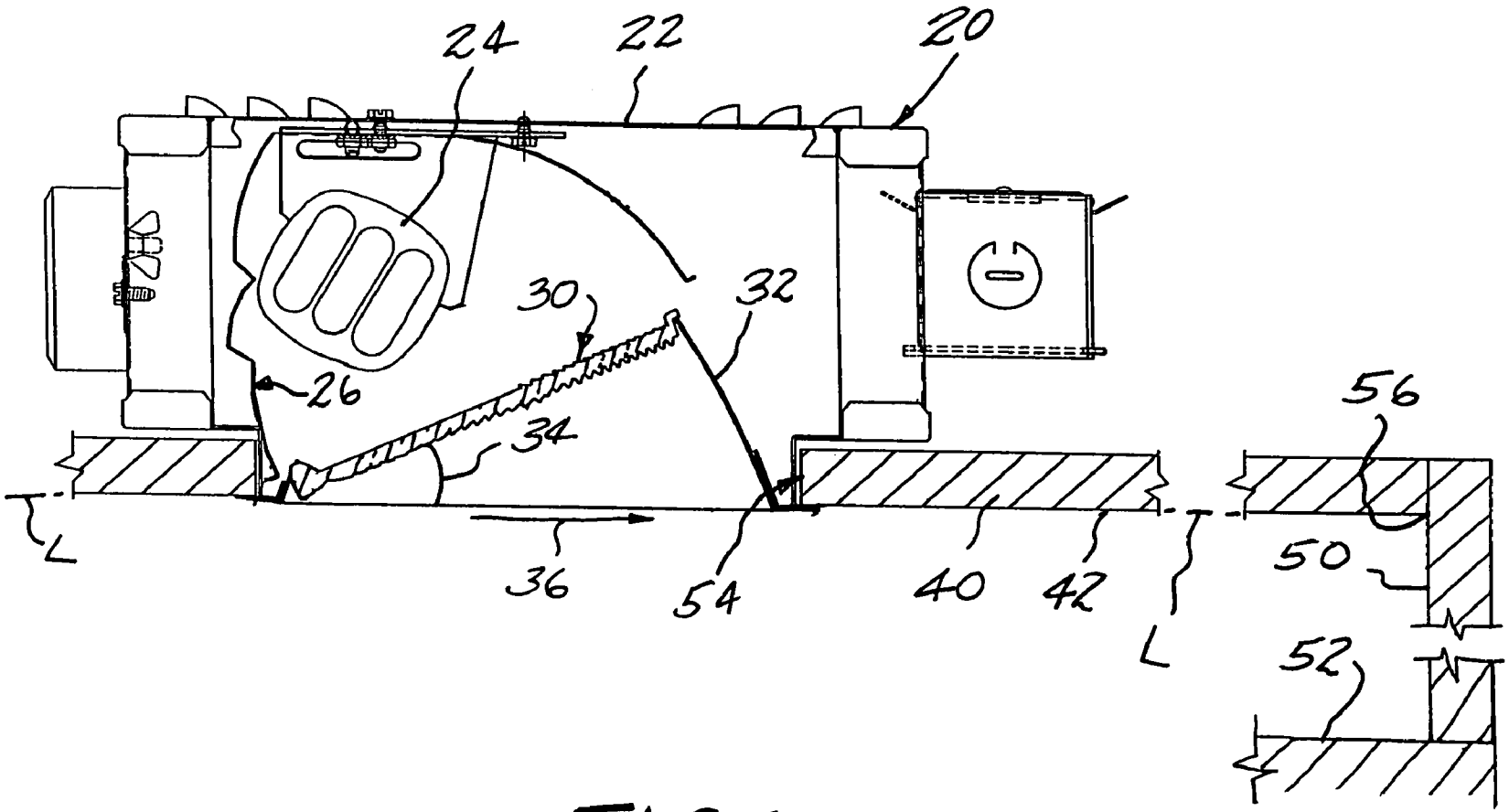
FIG. 1 is a longitudinal cross-sectional view of a wall-washer lighting fixture constructed in accordance with the present invention and installed within a ceiling, spaced from an adjacent wall for illumination of the wall in accordance with the invention.
Figure 5:
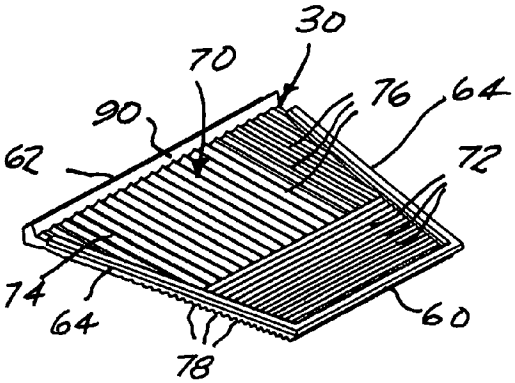
FIG. 5 is a top perspective view of the lens member.
Figure 6:
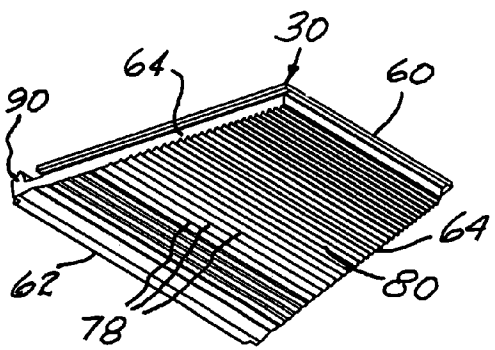
FIG. 6 is a bottom perspective view of the lens member.
Figure 4:
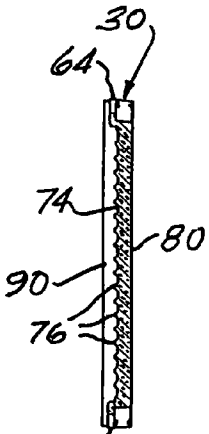
FIG. 4 is a lateral cross-sectional view taken along line 4—4 of FIG. 2.
Figure 2:
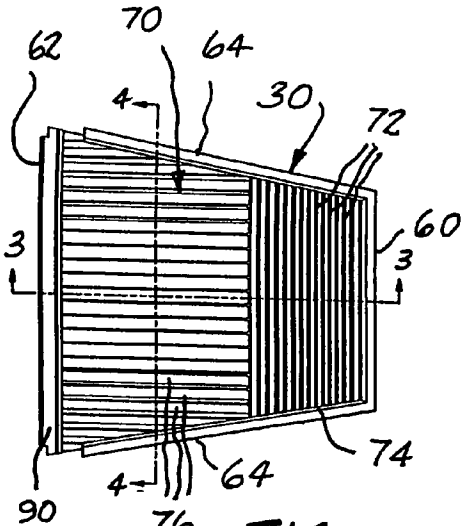
FIG. 2 is a top plan view of a lens member of the lighting fixture.
Figure 3:
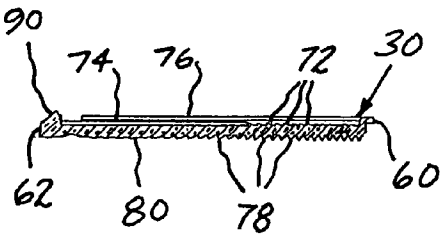
FIG. 3 is a longitudinal cross-sectional view taken along line 3—3 of FIG. 2.

Referring now to the drawing, and especially to FIG. 1 thereof, a wall-washer lighting fixture constructed in accordance with the present invention is shown at 20 and is seen to include a housing 22 within which there is mounted a light source in the form of a lamp 24. Lamp 24 may be any one of a variety of lamps, chosen from currently available incandescent, fluorescent or high-intensity discharge lamps, as well as light-emitting diodes. A reflector system 26 is interposed between the lamp 24 and housing 22 in a manner well-known in the construction of lighting fixtures. A lens member 30 is affixed within housing 22 by a support structure 32 of the housing 22 and is held at an acute angle 34 to the horizontal direction 36.

Lighting fixture 20 is shown installed within a ceiling 40, recessed so as to be essentially flush with generally horizontal surface 42 of the ceiling 40, the generally horizontal ceiling surface 42 being placed at a predetermined vertical level L; that is, lighting fixture 20 does not protrude below ceiling 40 to a degree which would disturb the aesthetic effect of a continuous, uninterrupted generally planar ceiling surface 42. Lighting fixture 20 is constructed so as to illuminate an adjacent generally vertical wall 50, as well to provide illumination to a floor 52 beneath the lighting fixture 20, and is installed at an installation site 54 spaced from wall 50 in a direction perpendicular to the wall 50. As a wall-washer of the present invention, lighting fixture 20 is constructed so as to provide illumination to wall 50 essentially all along wall 50 between floor 52 and ceiling 40, and so closely adjacent the intersection 56 between wall 50 and ceiling 40 as to reduce to a minimum and essentially eliminate any discernable, undesired shading which ordinarily can be present with conventional wall-washers.

As best seen in FIGS. 2 through 6, lens member 30 is generally planer and has a polygonal perimetric configuration, illustrated as a trapezoidal configuration, which includes a perimetric forward edge 60, a perimetric rearward edge 62 and perimetric side edges 64. A plurality of lens elements 70 include first lens elements in the form of lateral lens elements 72 extending along upper surface 74 of the lens member 30, between side edges 64, longitudinal lens elements 76 extending along upper surface 74 between rearward edge 62 and the lateral lens elements 72, and lateral lens elements 78 extending along lower surface 80 of lens member 30, between side edges 64. Lens elements 70 further include a second lens element 90 which extends along rearward edge 62, between side edges 64. Lens member 30 is transparent and preferably is constructed of glass.

Figure 7:
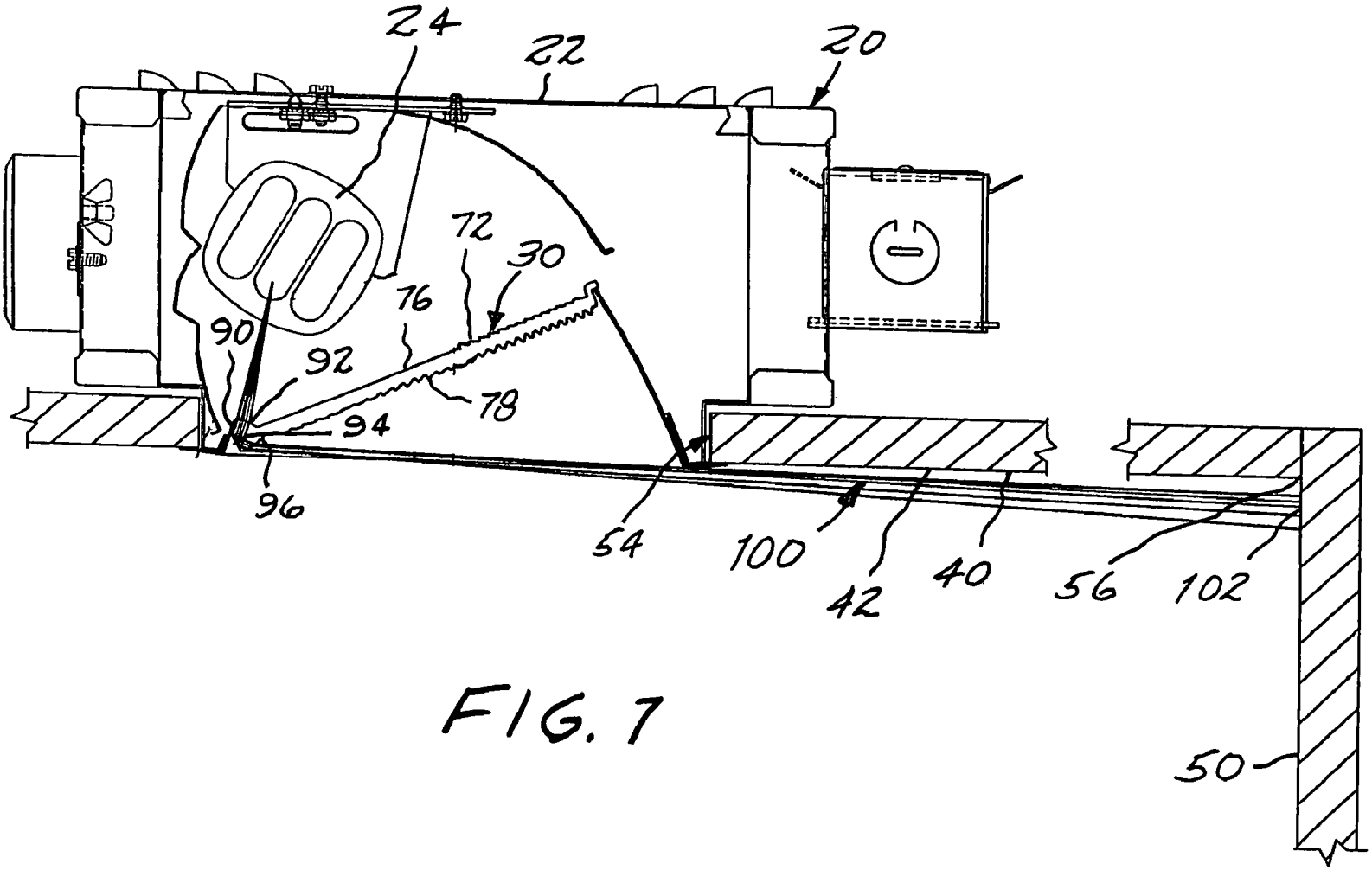
FIG. 7 is a diagrammatic longitudinal cross-sectional view, somewhat similar to FIG. 1, and showing paths of light directed by the lighting fixture toward the adjacent wall.
Figure 8:
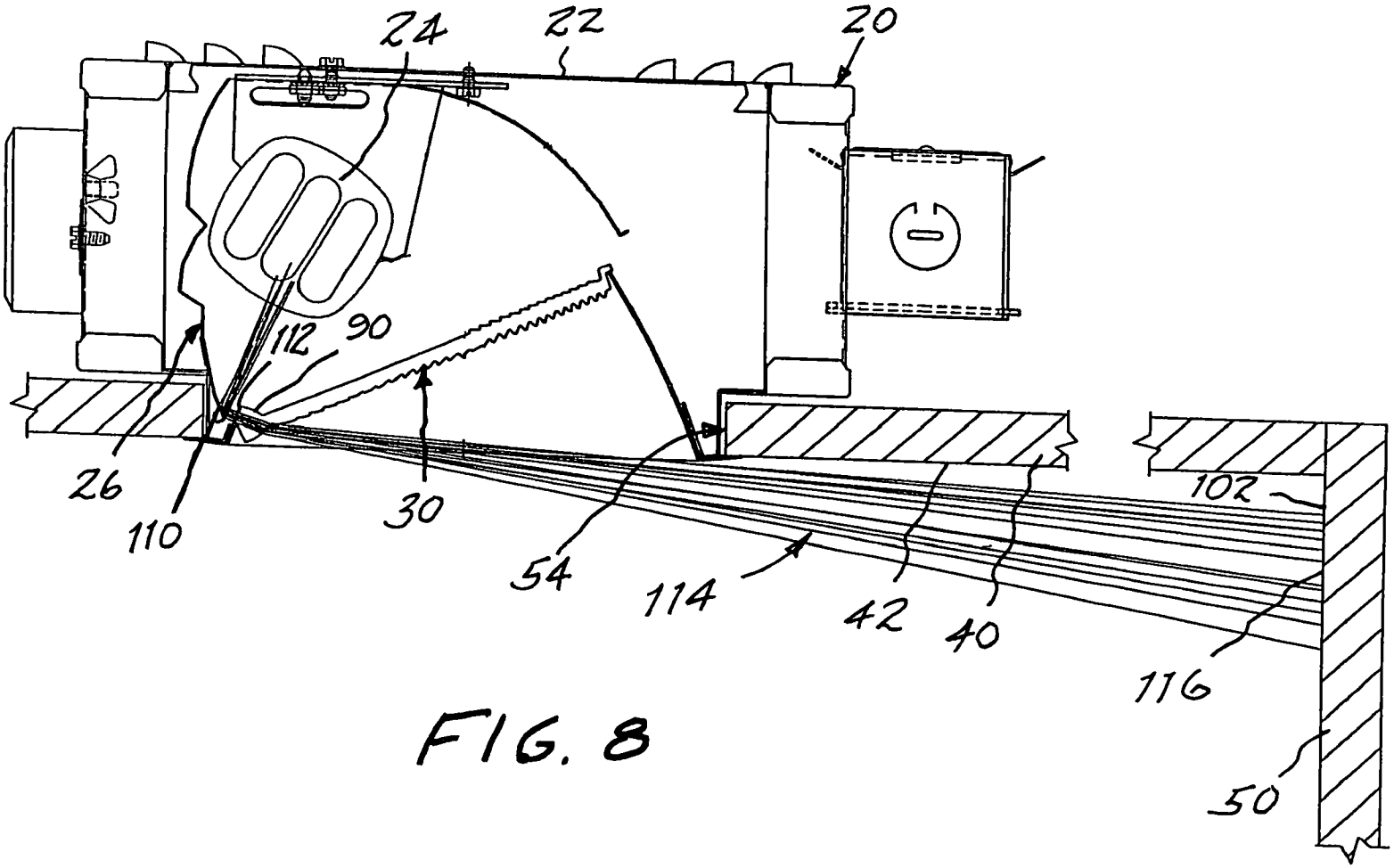
FIG. 8 is a view similar to FIG. 7, and showing further paths of light directed toward the adjacent wall.
Figure 9:
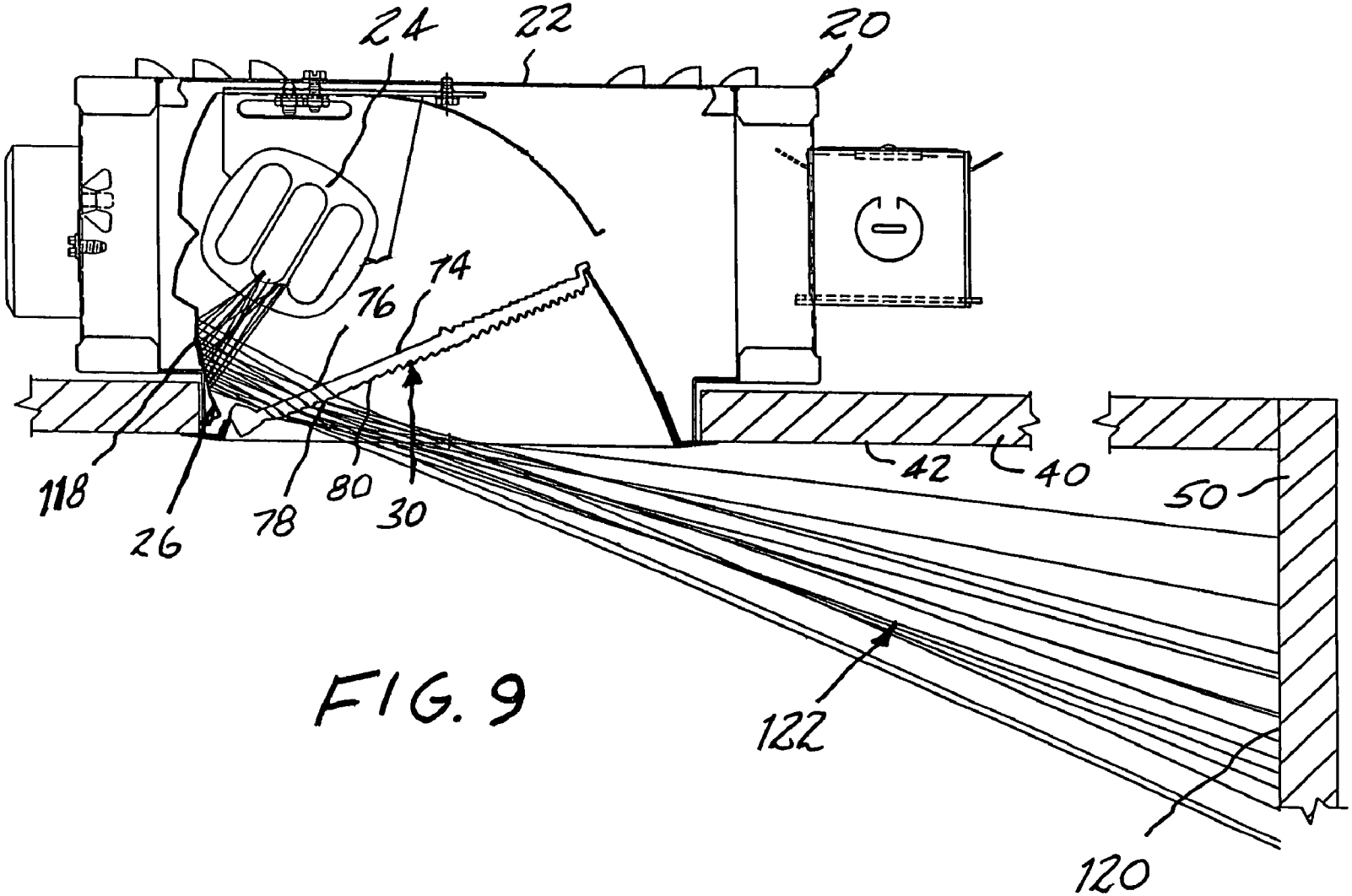
FIG. 9 is a view similar to FIG. 7, and showing still further paths of light directed toward the adjacent wall.
Figure 10:
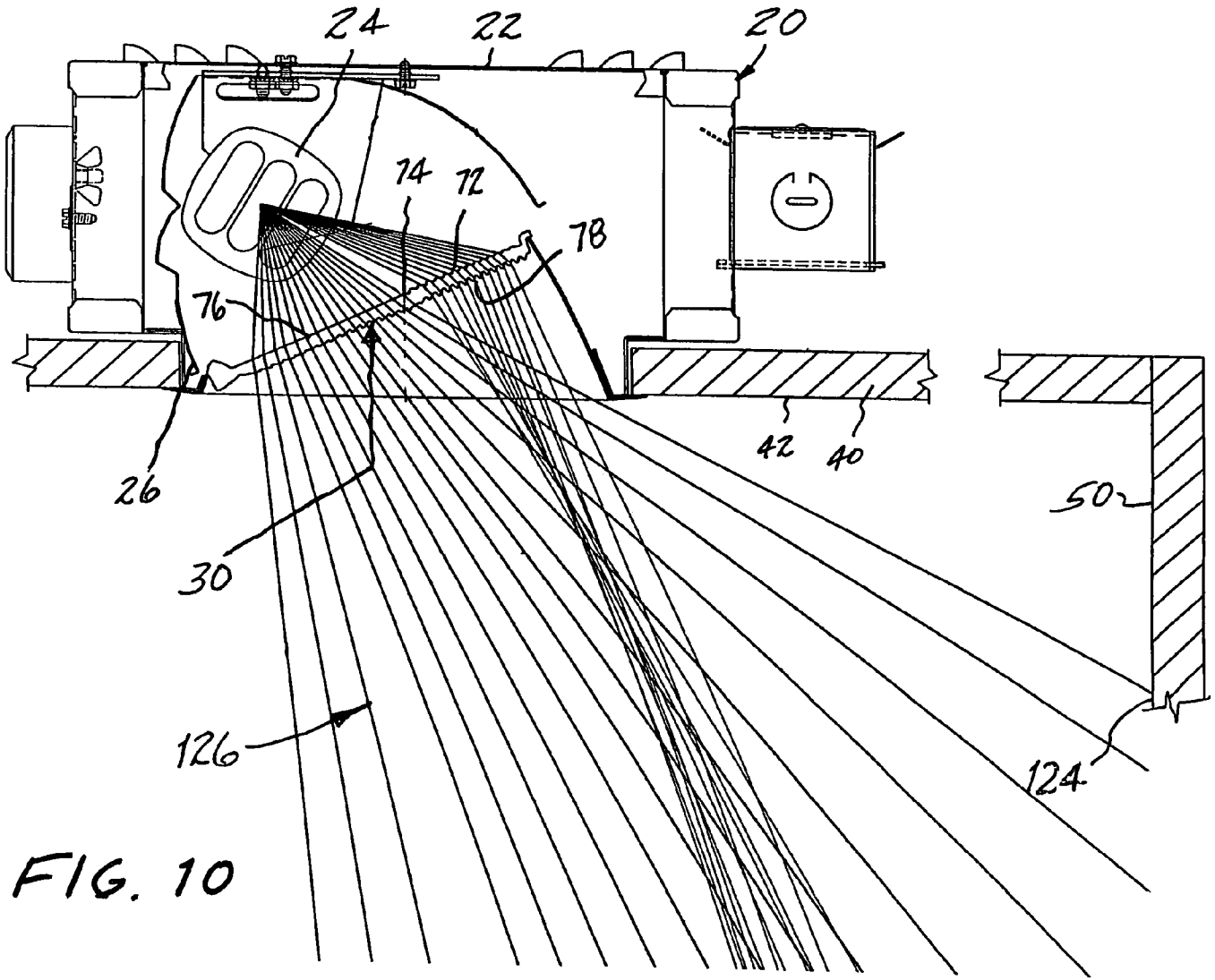
FIG. 10 is a view similar to FIG. 7, and showing yet further paths of light directed toward the adjacent wall.
Figure 10A:
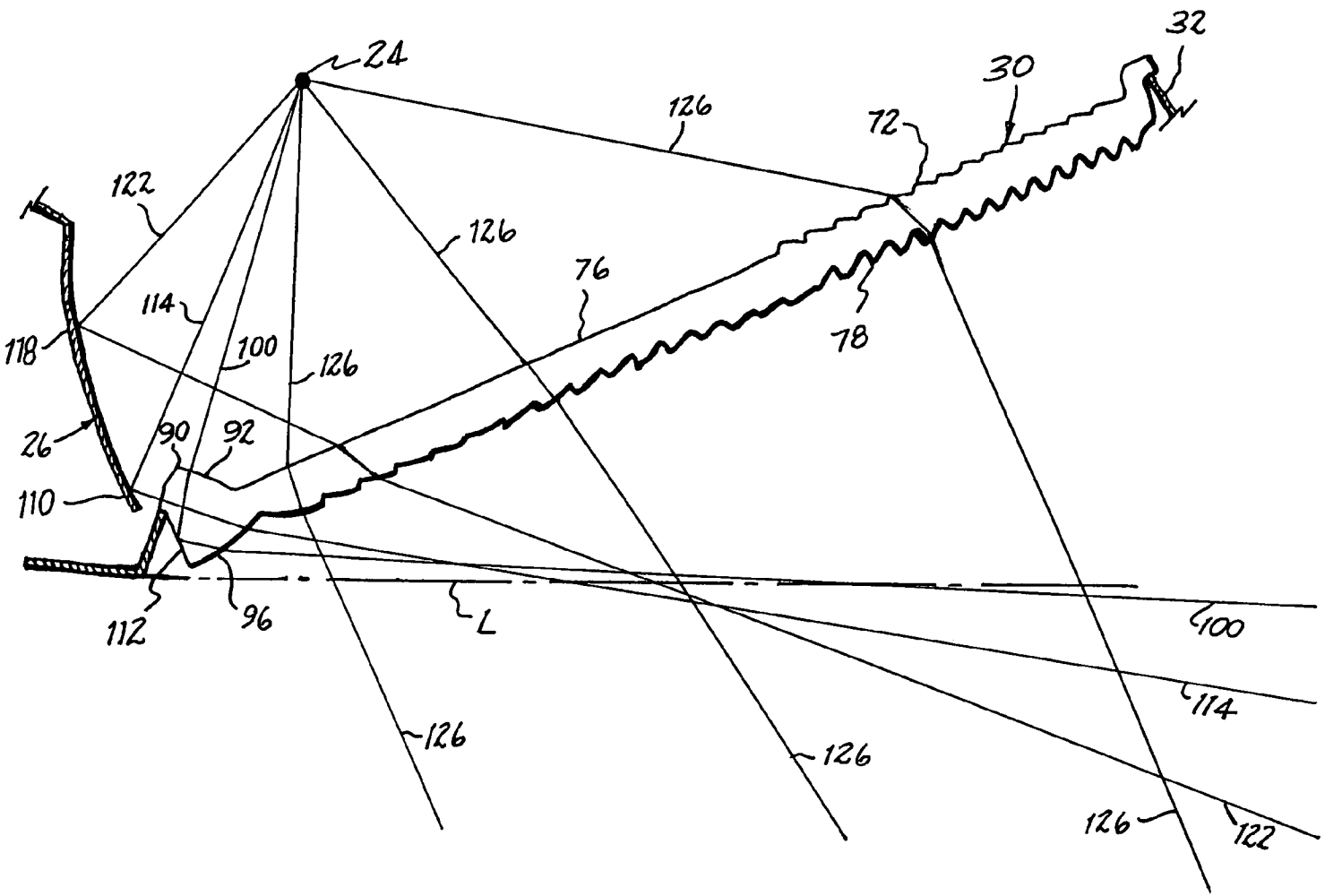
FIG. 10A is an enlarged fragmentary, largely diagrammatic view of portions of FIGS. 7 through 10, showing paths of light as directed by the lens member.
Figure 11:
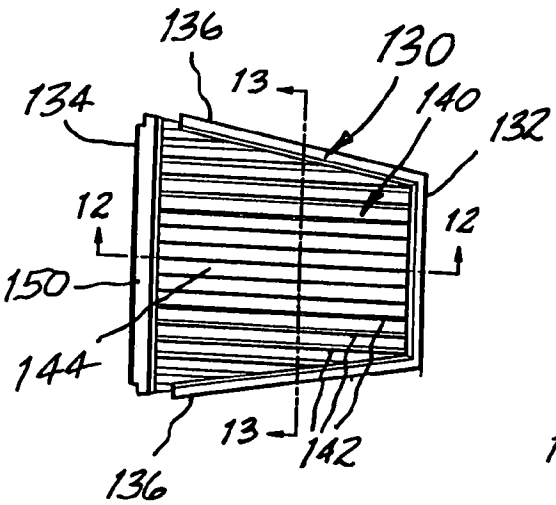
FIGS. 11 through 15 are similar to FIGS. 2 through 6, and show an alternate lens member.
Figure 13:
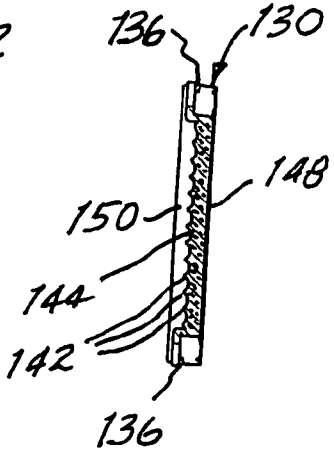
Figure 14:
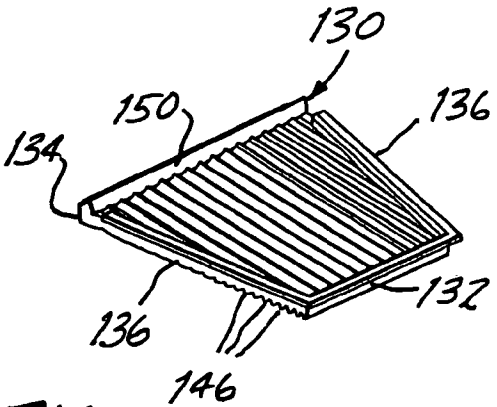
Figure 12:
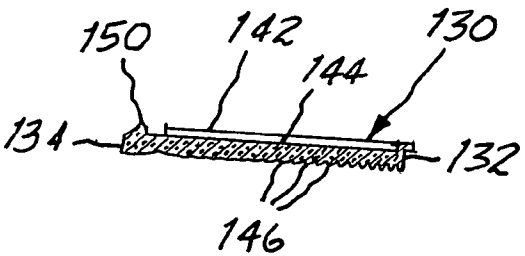
Figure 15:
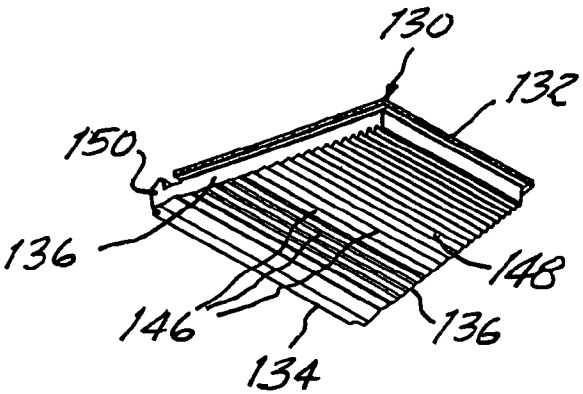

Turning now to FIGS. 7 through 10, viewed in conjunction with FIG. 10A, as seen in FIGS. 7 and 10A, lighting fixture 20 is installed at installation site 54 such that rearward edge 62, and consequently second lens element 90, is spaced farther from wall 50 than forward edge 60, and consequently lens elements 72, 76 and 78 and, by virtue of angle 34, lens element 90 is placed vertically lower than first lens elements 72, 76 and 78. Lens element 90 is oriented essentially horizontally, generally parallel to wall 50 and light emanating from lamp 24, located vertically above ceiling surface 42, and falling upon upper face 92 of lens element 90 is refracted and is directed, by total internal reflection at surface 94 of lens element 90, by virtue of the orientation, location and configuration of lens element 90, through lower face 96 to be refracted and directed along directions depicted by rays 100 to illuminate an area of wall 50, spread vertically along a wall surface portion 102 extending closely adjacent to intersection 56 between wall 50 and ceiling 40. Rays 100 are almost parallel to the surface 42 of ceiling 40 and are directed so close to intersection 56 as to provide sufficient illumination to avoid any discernable shading in the vicinity of intersection 56. Thus, wall surface 102 is illuminated essentially up to the intersection 56.

As illustrated in FIG. 8, viewed along with FIG. 10A, light emanating from lamp 24 and directed to a lower reflector portion 110 of reflector system 26 is reflected, by virtue of the orientation, location and configuration of lower reflector portion 110, to enter lens element 90 at a rear face 112 and, by virtue of the orientation, location and configuration of lens element 90, is spread by lens element 90, as depicted by rays 114, to illuminate a further area of wall 50 along a wall surface portion 116 immediate below wall surface portion 102.

As seen in FIGS. 9 and 10A, light emanating from lamp 24 and directed to an upper reflector portion 118 of reflector system 26 is reflected, by virtue of the orientation, location and configuration of upper reflector portion 118, so as to enter longitudinal lens elements 76 at upper surface 74 of lens member 30, pass through lens member 30 to lateral lens elements 78 extending along lower surface 80 of lens member 30 and be directed to still further areas of wall 50 along a wall surface portion 120 immediately below wall surface portion 116, as depicted by rays 122. By virtue of the orientation, location and configuration of lens elements 76 and 78, rays 122 are spread horizontally along wall surface portion 120 by longitudinal lens elements 76 oriented essentially horizontally, generally perpendicular to wall 50 while, at the same time, being spread vertically along wall surface portion 120 by lateral lens elements 78 oriented essentially horizontally, generally parallel to wall 50.

As shown in FIGS. 10 and 10A, light emanating from lamp 24 and directed to upper surface 74 of lens member 30 is further directed, by virtue of the location and configuration of first lens elements 72 and 78, oriented essentially horizontally, generally parallel to wall 50, and lens elements 76, oriented essentially horizontally, generally perpendicular to wall 50, to yet further areas of wall 50 along a wall surface portion 124, and toward floor 52, as illustrated by rays 126, to complete an overall more uniform pattern of illumination.

Referring now to FIGS. 11 through 15, an alternate lens member 130 also has a polygonal perimetric configuration, illustrated as a trapezoidal configuration, which includes a perimetric forward edge 132, a perimetric rearward edge 134 and perimetric side edges 136. A plurality of lens elements 140 include first lens elements in the form of longitudinal lens elements 142 extending along upper surface 144 of the lens member 130, between forward edge 132 and rearward edge 134, and lateral lens elements 146 extending along lower surface 148 of lens member 130, between side edges 136. Lens elements 140 further include a second lens element 150 which extends along rearward edge 134, between side edges 136. As described in connection with the embodiment of FIGS. 2 through 6, light falling upon lens member 130, from a light source, is spread horizontally by longitudinal lens elements 142 and vertically by lateral lens elements 146, by virtue of the orientation, location and configuration of lens elements 142 and 146, such that acting in concert with second lens element 150, an overall comprehensive pattern of illumination is completed, as described above.

Figure 16:
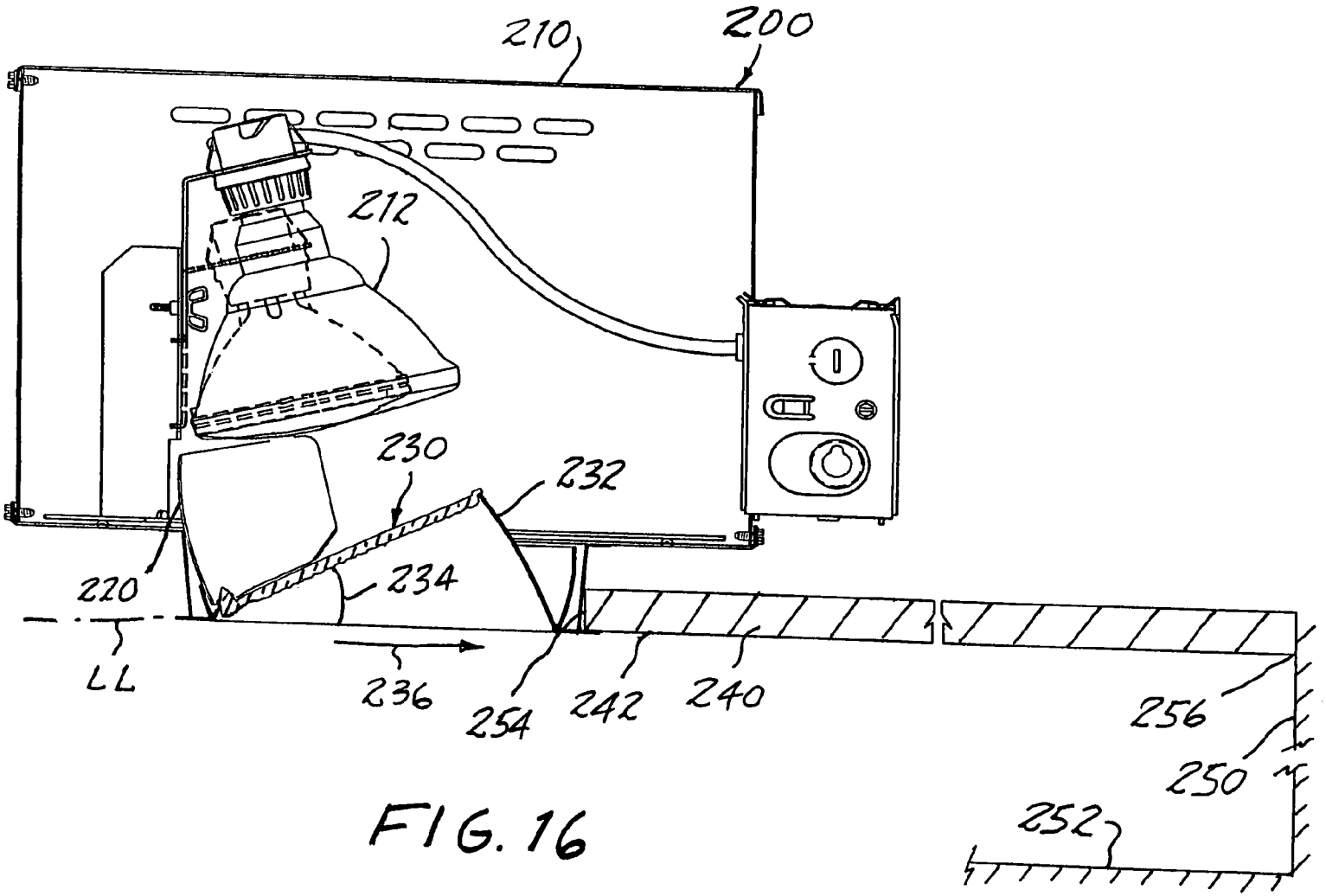
FIG. 16 is a longitudinal cross-sectional view of another wall-washer lighting fixture constructed in accordance with the present invention and installed within a ceiling, spaced from an adjacent wall.
Figure 20:
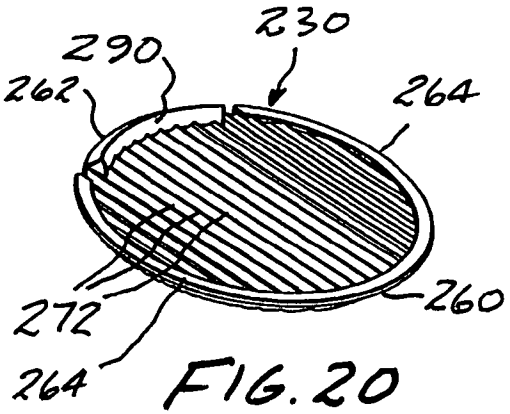
FIG. 20 is a top perspective view of the lens member.
Figure 21:
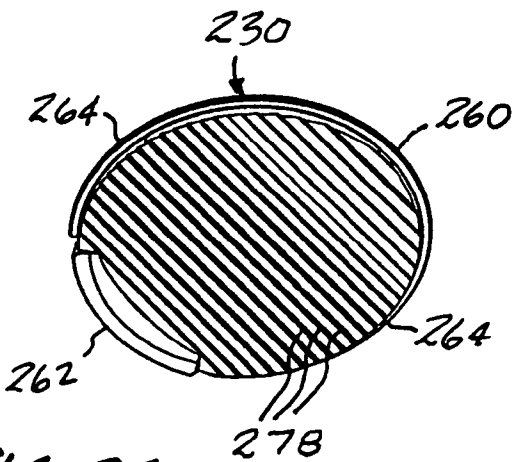
FIG. 21 is a bottom perspective view of the lens member.
Figure 19:
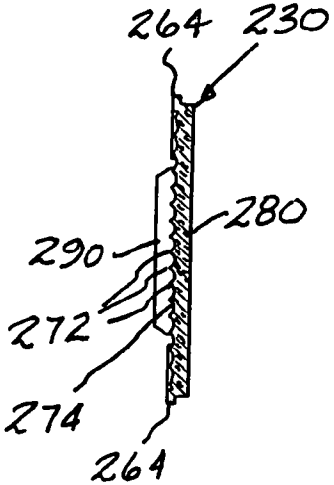
FIG. 19 is a lateral cross-sectional view taken alone line 19—19 of FIG. 17.
Figure 17:
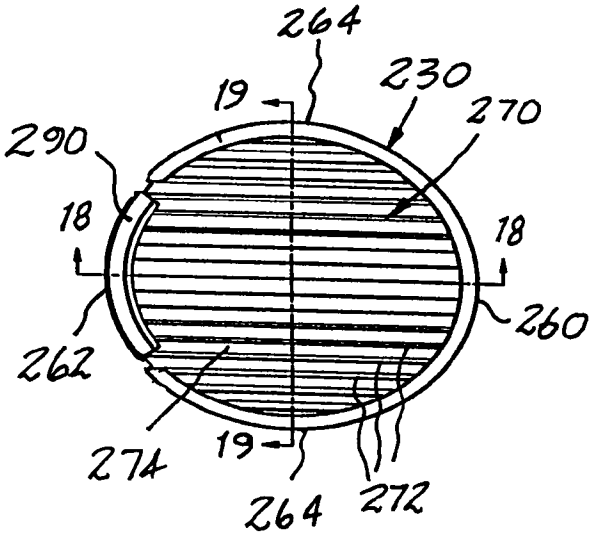
FIG. 17 is a top plan view of a lens member of the lighting fixture.
Figure 18:
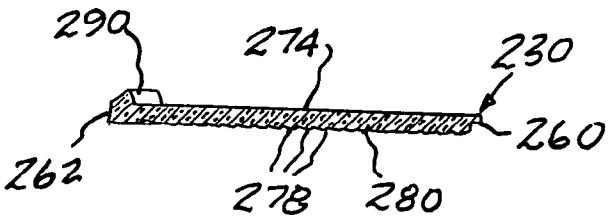
FIG. 18 is a longitudinal cross-sectional view taken along line 18—18 of FIG. 17.

Another embodiment of the present invention is illustrated in FIGS. 16 through 25. Turning first to FIG. 16, another wall-washer lighting fixture constructed in accordance with the present invention is shown at 200 and is seen to include a housing 210 within which there is mounted a light source in the form of a lamp 212. Lamp 212 is shown in the form of an incandescent lamp. A reflector 220 is interposed between the lamp 212 and housing 210 in a manner well-known in the construction of lighting fixtures. A lens member 230 is affixed within housing 210 by a support structure 232 of the housing 210 and is held at an acute angle 234 to the horizontal direction 236.

Lighting fixture 200 is installed within a ceiling 240, recessed so as to be essentially flush with surface 242 of the ceiling 240, the generally horizontal ceiling surface 242 being placed at a predetermined vertical level LL; that is, lighting fixture 200 does not protrude below ceiling 240 to a degree which would disturb the aesthetic effect of a continuous, uninterrupted generally planar ceiling surface 242. Lighting fixture 200 is constructed so as to illuminate an adjacent generally vertical wall 250, as well to provide illumination to a floor 252 beneath the lighting fixture 200, and is installed at an installation site 254 spaced from wall 250 in a direction perpendicular to the wall 250. As a wall-washer of the present invention, lighting fixture 200 is constructed so as to provide illumination to wall 250 essentially all along wall 250 between floor 252 and ceiling 240, and so closely adjacent the intersection 256 between wall 250 and ceiling 240 as to reduce to a minimum and essentially eliminate any discernable, undesired shading which ordinarily can be present with conventional wall-washers.

As best seen in FIGS. 17 through 21, lens member 230 is generally planar and has an elliptical perimetric configuration which includes a perimetric forward edge portion 260, a perimetric rearward edge portion 262 and perimetric side edge portions 264. A plurality of lens elements 270 include first lens elements in the form of longitudinal lens elements 272 extending along upper surface 274 of the lens member 230, between rearward edge portion 262 and forward edge portion 260, and lateral lens elements 278 extending along lower surface 280 of lens member 230, between side edge portions 264. Lens elements 270 further include a second lens element 290 which extends along rearward edge portion 262, between side edge portions 264. Lens member 230 is transparent and preferably is constructed of glass.

Figure 22:
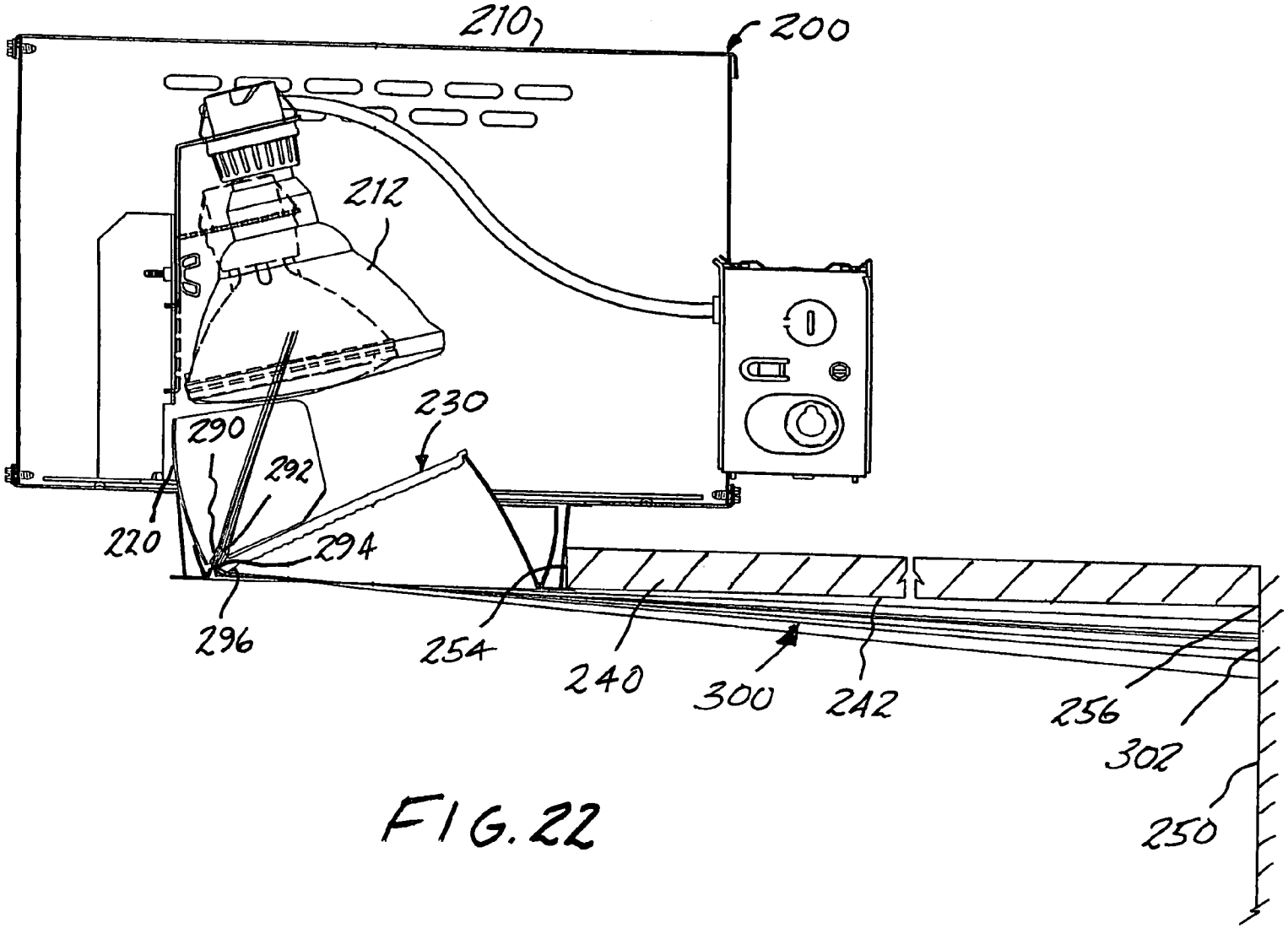
FIG. 22 is a diagrammatic longitudinal cross-sectional view, somewhat similar to FIG. 1, and showing paths of light directed by the lighting fixture of FIG. 14 toward the adjacent wall.

Turning now to FIGS. 22 through 25, as seen in FIG. 22, lighting fixture 200 is installed at installation site 254 such that rearward edge 262, and consequently second lens element 290, is spaced farther from wall 250 than forward edge 260, and consequently first lens elements 272, 276 and 278, and by virtue of angle 234, lens element 290 is placed vertically lower than first lens elements 272, 276 and 278. Lens element 290 is oriented essentially horizontally, generally parallel to wall 250 and light emanating from lamp 212 and falling upon upper face 292 of lens element 290 is refracted and is directed, by total internal reflection at surface 294 of lens element 290, by virtue of the orientation, location and configuration of lens element 290, through lower face 296 to be refracted and further directed along directions depicted by rays 300 to illuminate an area of wall 250, spread vertically along a wall surface portion 302 extending closely adjacent to intersection 256 between wall 250 and ceiling 240. Rays 300 are almost parallel to the surface 242 of ceiling 240 and are directed so close to intersection 256 as to provide sufficient illumination to avoid any discernable shading in the vicinity of intersection 256. Thus, wall surface 302 is illuminated essentially up to the intersection 256.

Figure 23:
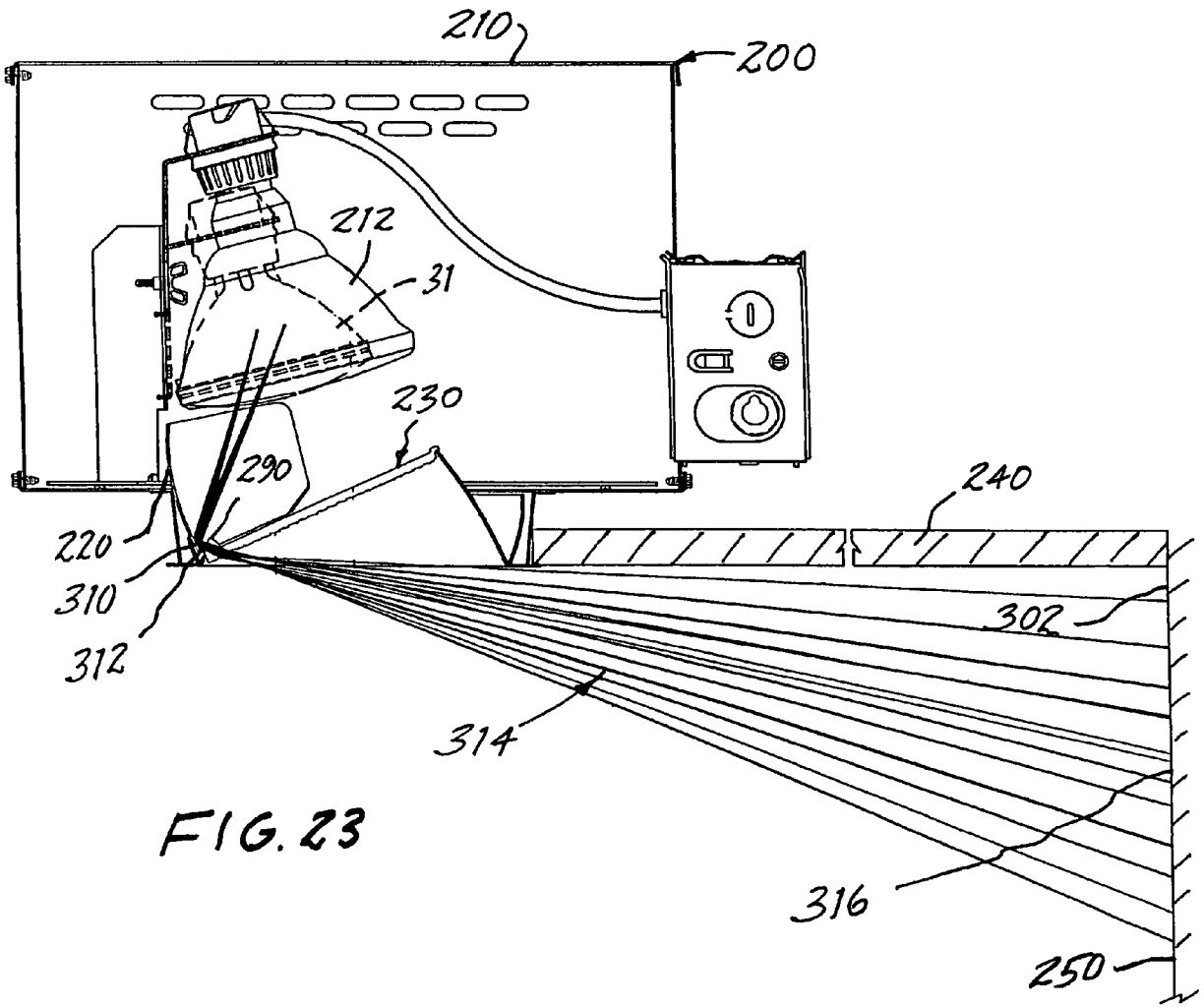
FIG. 23 is a view similar to FIG. 22, and showing further paths of light directed toward the adjacent wall.

As illustrated in FIG. 23, light emanating from lamp 212 and directed to a lower reflector portion 310 of reflector 220 is reflected, by virtue of the orientation, location and configuration of lower reflector portion 310, to enter lens element 290 at a rear face 312 and, by virtue of the orientation, location and configuration of lens element 290, is spread by lens element 290, as depicted by rays 314, to illuminate a further area of wall 250 along a wall surface portion 316 immediate below wall surface portion 302. An alternate light source is shown in dashed lines in the form of an alternate lamp 317.

Figure 24:
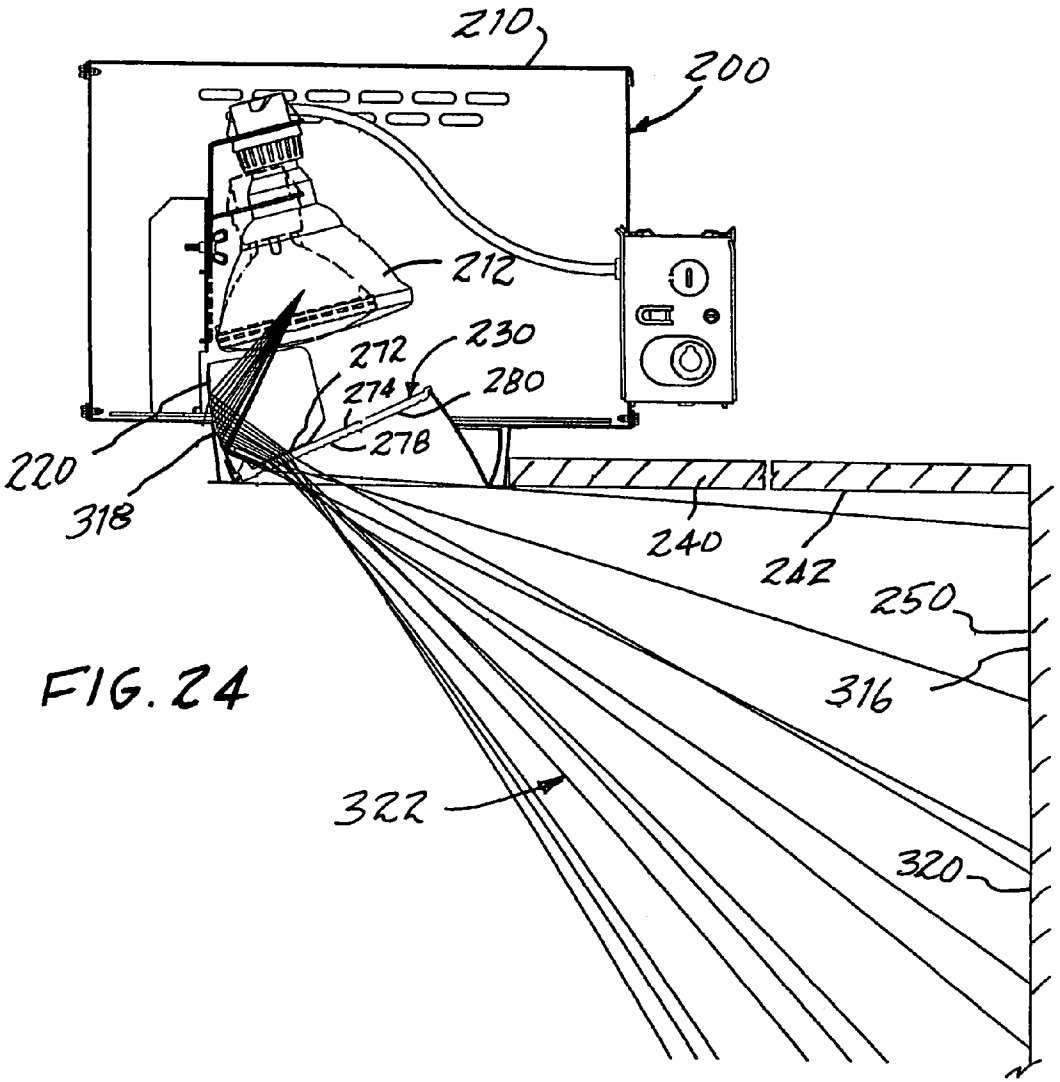
FIG. 24 is a view similar to FIG. 22, and showing still further paths of light directed toward the adjacent wall.

As seen in FIG. 24, light emanating from lamp 212 and directed to an upper reflector portion 318 of reflector 220 is reflected, by virtue of the orientation, location and configuration of upper reflector portion 318, to enter longitudinal lens elements 272 at upper surface 274 of lens member 230 to pass through lens member 230 to lateral lens elements 278 extending along lower surface 280 of lens member 230 and be directed to still further areas of wall 250 along a wall surface portion 320 immediately below wall surface portion 316, as depicted by rays 322. By virtue of the orientation, location and configuration of lens elements 272 and 278, rays 322 are spread horizontally along wall surface portion 320 by longitudinal lens elements 272, oriented essentially horizontally, generally perpendicular to wall 250, while, at the same time, being spread vertically along wall surface portion 320 by lateral lens elements 278 oriented essentially horizontally, generally parallel to wall 250.

Figure 25:
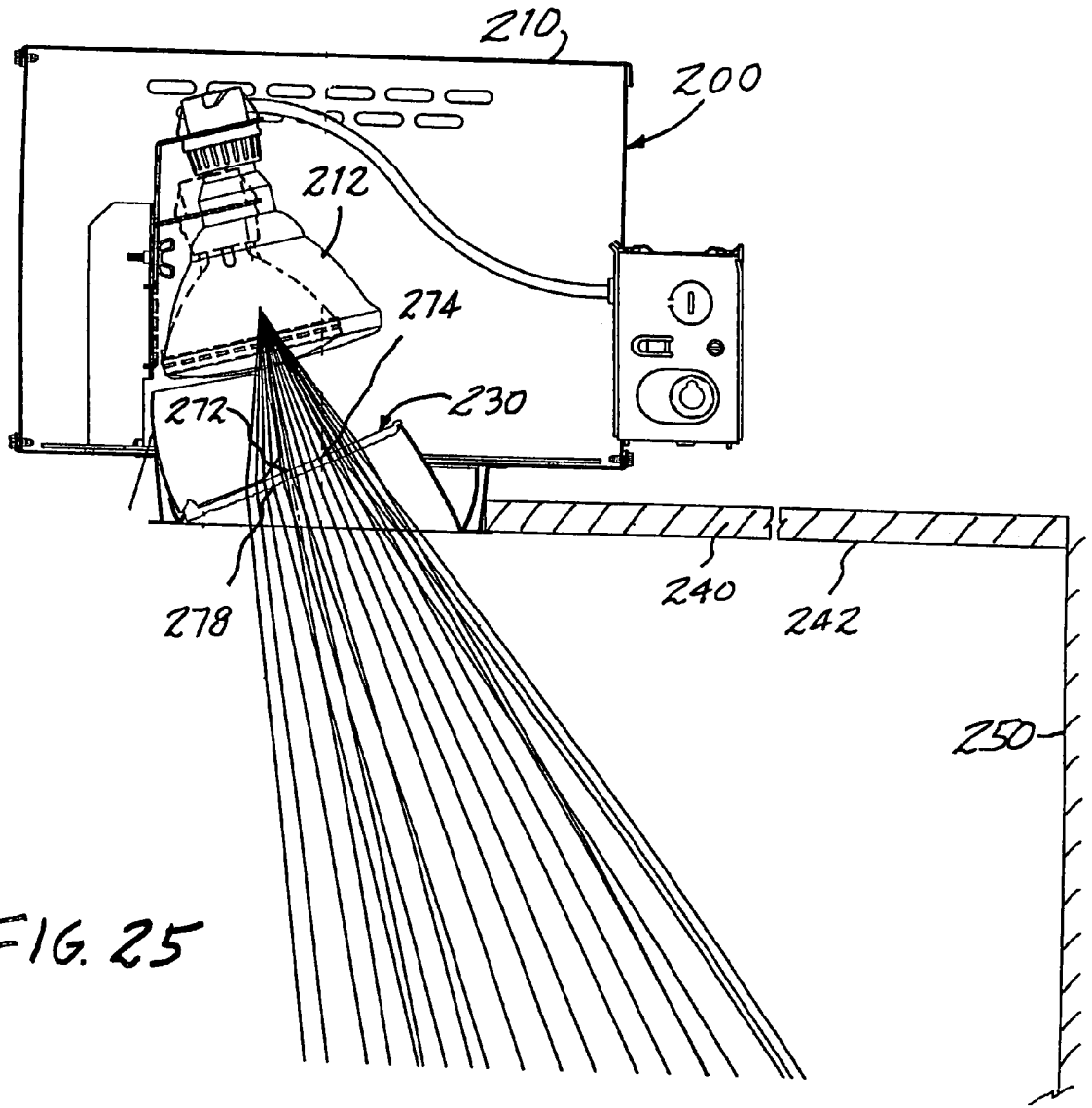
FIG. 25 is a view similar to FIG. 22, and showing yet further paths of light directed toward the adjacent wall.

As shown in FIG. 25, light emanating from lamp 212 and directed to upper surface 274 of lens member 230 is directed, by virtue of the orientation, location and configuration of first lens elements 272 and 278, to yet further areas of wall 250 along wall surface portions located vertically below portion 320, and toward floor 252 to complete an overall more uniform pattern of illumination.

It will be seen that the present invention attains all of the objects and advantages summarized above, namely: Allows the desired flush mounting of a ceiling wall-washer lighting fixture which accomplishes the illumination of an adjacent wall essentially all the way up to the intersection between the wall and the ceiling; provides an effective, unobtrusive ceiling-mounted wall-washer for casting light along an adjacent wall, without an undesirable shaded area near the intersection between the wall and the ceiling; incorporates a light-directing arrangement in a recessed ceiling-mounted wall-washer lighting fixture and method for enabling the illumination of a wall essentially all the way up to the intersection of the wall with the ceiling; extends the useful range of installations of wall-washer lighting fixtures by virtue of enabling essentially complete and more uniform illumination of a wall by a flush-mounted wall-washer; attains aesthetically appealing lighting effects with less complex lighting fixture installations; provides effective and desirable illumination with increased ease and economy of installation for widespread adoption and use.

It is to be understood that the above detailed description of preferred embodiments of the invention is provided by way of example only. Various details of design, construction and procedure may be modified without departing from the true spirit and scope of the invention, as set forth in the appended claims.

What is claimed is:

1. A wall-washer lighting fixture for placement in a ceiling at an installation site located relative to a generally horizontal ceiling surface placed at a predetermined vertical level, the installation site further being located adjacent an intersection between the ceiling surface and a generally vertical wall surface, with the lighting fixture essentially flush with the ceiling surface and directing light horizontally and vertically along the wall surface closely adjacent to the intersection in order to illuminate the wall surface while reducing to a minimum any shaded area along the wall surface adjacent the intersection, the lighting fixture comprising:

a light source for location vertically above the ceiling surface when the lighting fixture is at the installation site;

a plurality of lens elements for placement between the light source and the predetermined vertical level of the ceiling surface when the lighting fixture is at the installation site, to receive light from the light source and direct such received light toward the wall surface, the plurality of lens elements including first lens elements oriented, located and configured for directing light received from the light source toward first areas of the wall surface spaced vertically downwardly from the intersection, and a second lens element located vertically lower than the first lens elements and oriented and configured for directing light received from the light source toward second areas of the wall surface, between the first areas and the intersection between the ceiling surface and the wall surface, so as to illuminate the wall surface while reducing to a minimum any shaded area along the wall surface adjacent the intersection.

2. The lighting fixture of claim 1 wherein the second lens element is oriented, located and configured for directing at least a portion of the light received from the light source toward the wall surface by total internal reflection.

3. The lighting fixture of claim 1 wherein the second lens element is placed horizontally farther from the intersection, when the lighting fixture is at the installation site, than the placement of the first lens elements.

4. The lighting fixture of claim 1 wherein at least some of the first lens elements extend generally parallel to the wall surface, when the lighting fixture is at the installation site, for directing light received from the light source vertically along the wall surface.

5. The lighting fixture of claim 4 wherein at least some of the first lens elements extend generally perpendicular to the wall surface, when the lighting fixture is at the installation site, for directing light received from the light source horizontally along the wall surface.

6. The lighting fixture of claim 1 wherein at least some of the first lens elements extend generally perpendicular to the wall surface, when the lighting fixture is at the installation site, for directing light received from the light source horizontally along the wall surface.

7. The lighting fixture of claim 1 wherein the first and second lens elements are integrated into a lens member having a first perimetric edge for being spaced a first horizontal distance from the intersection between the ceiling surface and the wall surface, when the lighting fixture is at the installation site, and a second perimetric edge for being spaced a second horizontal distance from the intersection, the second horizontal distance being greater than the first horizontal distance, and the second lens element is located adjacent the second perimetric edge.

8. The lighting fixture of claim 7 wherein the lens member extends at an angle to the ceiling surface such that the second perimetric edge is located vertically lower than the first perimetric edge, when the lighting fixture is at the installation site.

9. The lighting fixture of claim 7 wherein the lens member has an upper surface and a lower surface, and at least some of the first lens elements extend along one of the upper surface and the lower surface, generally parallel to the wall surface, when the lighting fixture is at the installation site, for directing light received from the source vertically along the wall surface.

10. The lighting fixture of claim 7 wherein the lens member has an upper surface and lower surface, and at least some of the first lens elements extend along one of the upper surface and the lower surface, generally perpendicular to the wall surface, when the lighting fixture is at the installation site, for directing light received from the light source horizontally along the wall surface.

11. The lighting fixture of claim 7 wherein the lens member has an upper surface and a lower surface, at least some of the first lens elements extend along the lower surface, generally parallel to the wall surface, when the lighting fixture is at the installation site, for directing light received from the source vertically along the wall surface, and at least some of the first lens elements extend along the upper surface, generally perpendicular to the wall surface, when the lighting fixture is at the installation site, for directing light received from the light source horizontally along the wall surface.

12. The lighting fixture of claim 11 wherein the lens member extends at an angle to the ceiling surface such that the second perimetric edge is located vertically lower than the first perimetric edge, when the lighting fixture is at the installation site.

13. The lighting fixture of claim 7 wherein the lens member is generally planar and includes an essentially polygonal perimetric configuration.

14. The lighting fixture of claim 7 wherein the lens member is generally planar and includes an essentially elliptical perimetric configuration.

15. The lighting fixture of claim 1 including a reflector system oriented, located and configured for reflecting light from the light source to at least some of the plurality of lens elements.

16. The lighting fixture of claim 15 wherein the reflector system is oriented, located and configured for reflecting light from the light source to the second lens element.

17. The lighting fixture of claim 16 wherein the second lens element is oriented, located and configured for directing reflected light toward the wall surface by refraction.

18. A method for lighting a generally vertical wall surface with a lighting fixture placed in a ceiling at an installation site located relative to a generally horizontal ceiling surface located at a predetermined vertical level, the installation site further being located adjacent an intersection between the ceiling surface and the generally vertical wall surface, with the lighting fixture essentially flush with the ceiling surface and directing light from a light source horizontally and vertically along the wall surface closely adjacent to the intersection in order to illuminate the wall surface while reducing to a minimum any shaded area along the wall surface adjacent the intersection, the method comprising:

placing a plurality of lens elements between the light source and the predetermined vertical level of the ceiling surface to receive light from the light source and direct such received light toward the wall surface, the placement of the plurality of lens elements including placing first lens elements so as to direct light received from the light source toward first areas of the wall surface spaced vertically downwardly from the intersection; and placing a second lens element vertically lower than the first lens elements so as to direct light received from the light source toward second areas of the wall surface, between the first areas and the intersection between the ceiling surface and the wall surface, so as to illuminate the wall surface while reducing to a minimum any shaded area along the wall surface adjacent the intersection.

19. The method of claim 18 including placing the second lens element horizontally farther from the intersection than the placement of the first lens elements.

* * * * *